US005572083A

United States Patent [19]

Antonis et al.

[11] Patent Number: 5,572,083

[45] Date of Patent: Nov. 5, 1996

[54] ELECTROLESS LOW-PRESSURE DISCHARGE LAMP

[75] Inventors: Petrus H. Antonis; Hendrik J. Eggink; Winand H. A. M. Friederichs, all of Eindhoven, Netherlands

[73] Assignee: U.S. Philips Corporation, New York, N.Y.

[21] Appl. No.: 426,441

[22] Filed: Apr. 21, 1995

Related U.S. Application Data

[63] Continuation of Ser. No. 83,803, Sep. 3, 1993, abandoned.

[30] Foreign Application Priority Data

Jul. 3, 1992 [EP] European Pat. Off. ..... 92202026

[51] Int. Cl.[6] ..... H01J 1/50

[52] U.S. Cl. ..... 313/46; 313/43; 313/161; 313/493

[58] Field of Search ..... 313/46, 43, 161, 313/493; 362/263; 315/248

[56] References Cited

U.S. PATENT DOCUMENTS

| | | | |
|---|---|---|---|
| 3,936,686 | 2/1976 | Moore | 313/36 |
| 4,536,675 | 8/1985 | Postma | 313/46 |
| 4,661,746 | 4/1987 | Postma et al. | 315/248 |
| 4,728,867 | 3/1988 | Postma et al. | 315/248 |
| 4,922,157 | 5/1990 | Van Engen et al. | 315/248 |
| 4,927,217 | 5/1990 | Kroes et al. | 315/248 |
| 4,977,354 | 12/1990 | Bergervoet et al. | 315/248 |
| 5,006,752 | 4/1991 | Eggink et al. . | |
| 5,130,912 | 7/1992 | Friederichs et al. | 362/263 |
| 5,258,683 | 11/1993 | Eggink et al. | 313/35 |
| 5,291,091 | 3/1994 | Eggink et al. | 313/161 |

FOREIGN PATENT DOCUMENTS

| | | | |
|---|---|---|---|
| 0384520 | 8/1990 | European Pat. Off. | H01J 65/04 |
| 0456289 | 11/1991 | European Pat. Off. . | |
| 0496463 | 7/1992 | European Pat. Off. | H01J 65/04 |
| 0496464 | 7/1992 | European Pat. Off. | H01J 65/00 |
| 2566177 | 6/1985 | France | H01J 65/04 |

*Primary Examiner*—Sandra L. O'Shea
*Assistant Examiner*—Vip Patel
*Attorney, Agent, or Firm*—Brian J. Wieghaus

[57] ABSTRACT

The electrodeless low pressure discharge lamp has a lamp vessel (1) which is fused to the flared portion (6) of a flared tube (5) which extends into the lamp vessel. A power coupler (20) is demountably secured to the lamp vessel and comprises a soft magnetic core (21), surrounded by an electric coil (22), and a heat conducting element (23) in the core. This element is a solid rod, the coil (22) is present in a region (8) adjacent the flared portion (6) of the flared tube (5), and an elastic material couples the rod (23) laterally to the core (21). The construction of the lamp avoids the use of an expensive heat pipe as a heat conducting element.

14 Claims, 1 Drawing Sheet

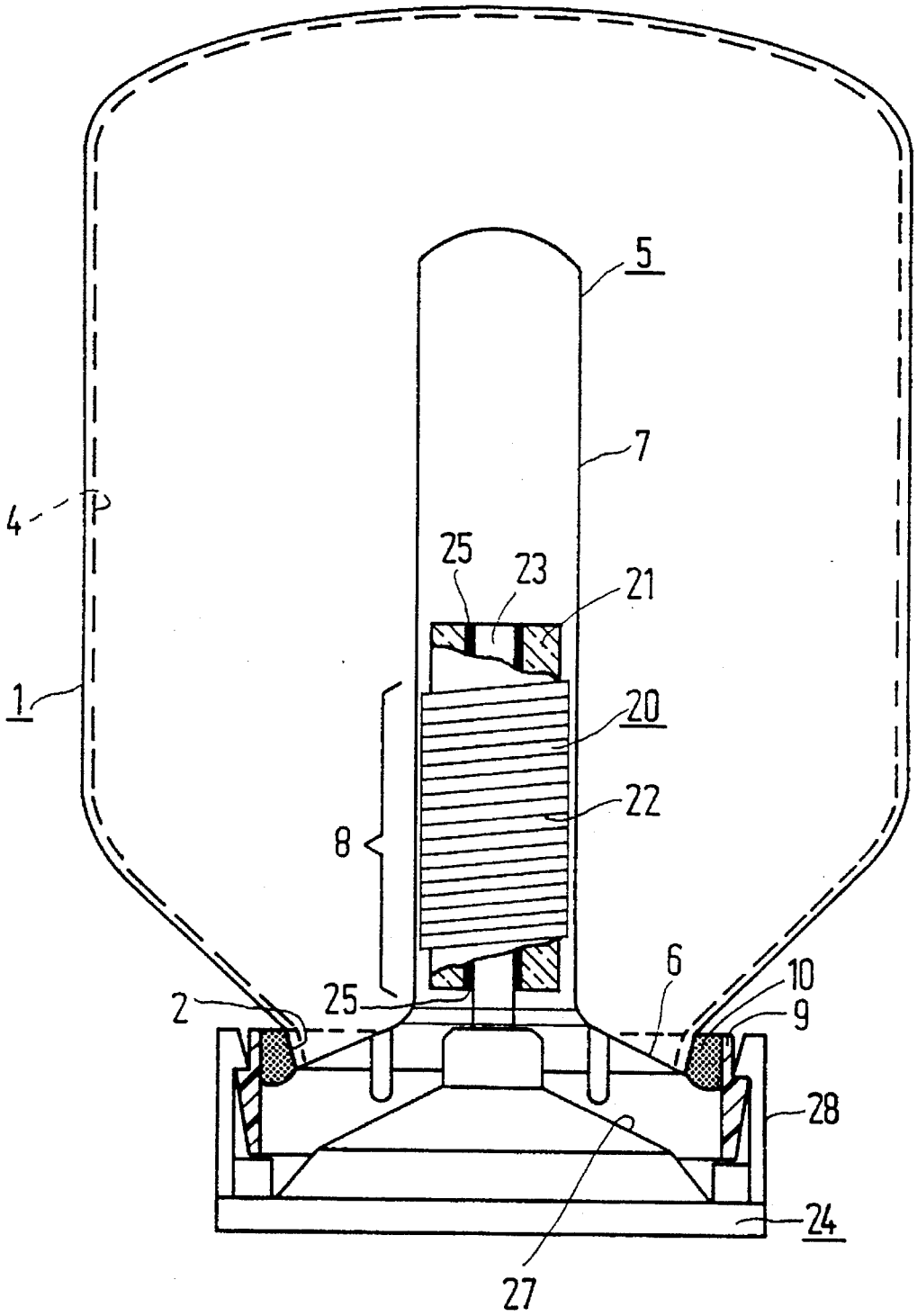
5
7
4
25
23
21
1
20
22
8
6
10
2
25
9
28
24
27

ELECTROLESS LOW-PRESSURE DISCHARGE LAMP

This is a continuation of application Ser. No. 08/083,803, filed on Sep. 3, 1993, now abandoned.

BACKGROUND OF THE INVENTION

The invention relates to an electrodeless low-pressure discharge lamp comprising:

a lamp vessel closed in a vacuumtight manner and comprising a neck-shaped end portion, which lamp vessel has an ionizable filling comprising a rare gas, and has at its end portion a tube which extends into the lamp vessel and which comprises a flared portion fused to the lamp vessel and connected thereto a cylindrical portion;

a power coupler fastened to the lamp vessel in a detachable manner, which coupler comprises in the tube a core of soft magnetic material, an electric coil around the core, and a heat-conducting element in the core, which element extends to outside the lamp vessel and carries a flange there.

Such an electrodeless low-pressure discharge lamp is known from EP 0 456 289-A1 and also from U.S. Pat. No. 5,006,752.

The tube in the known lamp runs through substantially the entire lamp vessel length. The core with the coil lies in a zone situated at the end of the tube which lies inside the lamp vessel. A good transfer of the power into the ionizable filling is obtained thereby.

The known lamp is of a type which dissipates a comparatively high power, for example, approximately 80 to 90 W. Heat is generated during lamp operation, which heat should be removed in order to prevent the core assuming a temperature close to, or even above its Curie point. This is because the specific magnetic losses increase strongly with temperatures rising up to the Curie point, while the magnetic permeability decreases.

To counteract the risk of an excessive temperature of the core, the known lamp comprises a hollow pipe containing a liquid as the heat-conducting element. The liquid evaporates in a zone of the pipe situated in the core and the vapour condenses in a zone outside the lamp vessel. The condensation heat is transmitted to the surroundings by the flange. To ensure that the liquid flows to the zone in the core, also against the force of gravity if this zone should be above the flange, gauze is present in the pipe so as to provide a capillary structure which sucks the liquid upwards. The known tube provided with liquid and gauze has a very high heat-transporting capability, so that it is possible for the lamp to dissipate a comparatively high electric power with a comparatively high efficacy.

A disadvantage of the known lamp, however, is that the pipe is an expensive component.

SUMMARY OF THE INVENTION

The invention has for its object to provide a lamp of the kind described in the opening paragraph which is of a simple construction in which the necessity of the use of a pipe provided with liquid and gauze as the heat-conducting element is avoided.

According to the invention, this object is achieved in that the coil is present in a zone of the tube which adjoins the flared portion, the element is a solid rod, and the rod is laterally coupled to the core by means of an elastic material.

It was found that an efficient power transfer is nevertheless obtained when the coil and the core extend only over a small distance inside the lamp vessel in that they are present adjacent the end portion of the lamp vessel. A favourable result of this is a comparatively short heat transport path to the exterior.

It is not easy to give the core a close contact with the rod owing to differences in coefficient of thermal expansion between the core material and rod material, the fragility of the core, and tolerances on the dimensions of these bodies. Heat transfer from the core to the rod, for which in addition only a comparatively small surface area is available, is then also severely hampered by the clearance which the rod has inside the core. This is a disadvantage because the rod has a smaller heat-transporting capacity as it is, compared with a tube provided with liquid.

The lateral coupling between the rod and the core, for example ferrite, for example Philips 4C6, by means of an elastic material, however, provides a good heat transfer while the dimensional tolerances and the compensation of different coefficients of thermal expansion are maintained.

Positioning of the coil and the use of the elastic material render possible the use of a comparatively inexpensive solid rod, for example made of metal such as copper or aluminium, or of thermally conducting ceramic material such as, for example, aluminium nitride, which has a thermal conductivity level equal to that of aluminium.

The lamp according to the invention with its detachable power coupler renders it possible to exchange the lamp vessel for another, for example, when the lamp vessel has been broken or a light colour different from the original one is desired, without in such cases the entire lamp having to be discarded. The lamp is indeed capable of burning several tens of thousands of hours, for example 60000 hours, with a good luminous efficacy maintainance.

In a favourable embodiment, the rod has a flange, for example made of copper, aluminium, or brass, for example of $CuZn_{15}$, with a surface narrowing, for example conically, towards the rod. As a result, the flange has a surface which faces away from the rod and which is permanently plane for making contact with the surroundings. On the other hand, the rod and the flange have a better heat contact thereby, while the weight of the lamp is less than in the case in which the flange were a cylindrical slice of the same height.

The rod and the flange may be united by an interference fit, or alternatively by a fastening with solder, glue or cement, or by a shrunk or clamped connection of the flange around the rod. Another possibility is for the rod to be screwed into the flange, or for the flange to be integral with the rod.

In an embodiment, the tube extending in the lamp vessel has a length usual for the known lamp, i.e. an excess length for the power coupler of the lamp according to the invention. This has the advantage that the lamp vessel of the lamp according to the invention can also be used for the known lamp with its comparatively long power coupler.

An elastic polymer may be used, for example, rubber such as, for example, silicone rubber as the elastic material for coupling the rod to the core.

The ionizable filling may comprise, for example, argon, neon, xenon, or mixtures of rare gases, and possibly mercury. The lamp vessel may have a coating of fluorescent powder, for example, in the case in which the filling comprises mercury.

BRIEF DESCRIPTION OF THE DRAWING

An embodiment of the lamp according to the invention is shown in the drawing in side elevation, partly in longitudinal section.

DESCRIPTION OF THE PREFERRED EMBODIMENT

In the Figure, the electrodeless low-pressure discharge lamp has a lamp vessel 1 which is closed in a vacuumtight manner and comprises a neck-shaped end portion 2. The lamp vessel has an ionizable filling, of mercury and rare gas in the Figure, and a fluorescent powder 4 at an inner surface. Fused to the lamp vessel there is, at its end portion 2, a tube 5 which extends into the lamp vessel, and which comprises a flared portion 6 fused to the lamp vessel and connected thereto a cylindrical portion 7.

A power coupler 20 is detachably fastened to the lamp vessel 1. The power coupler has a core 21 of soft magnetic material in the tube 5, an electric coil 22 around the core 21, and a heat-conducting element 23 in the core 21. The element extends to outside the lamp vessel 1 and carries a flange 24 there.

The coil 22 is present in a zone 8 of the tube 5 which adjoins the flared portion 6; the dement 23 is a solid rod, and the rod 23 is laterally coupled to the core 21 by an elastic material 25. The packing with the elastic material provides a good heat transfer from the core to the rod.

The flange 24 has a surface 27 which narrows towards the rod 23. In the Figure, the flange 24 is made of copper and integral with the rod 23. The elastic material 25 in the Figure is silicone rubber.

A synthetic resin collar 9 is fixed around the neck-shaped portion 2 of the lamp vessel by means of cement 10. The flange 24 carries hooks 28 by which the power coupler 20 is detachably fastened to the lamp vessel 1.

Compared with the power coupler, the tube 7 has an excess length. The lamp shown may dissipate a power of, for example, 40 to 85 W, depending on its dimensions.

We claim:

1. An electrodeless low pressure discharge lamp, comprising:

a) a lamp vessel closed in a gas-tight manner and comprising a dome end, an end portion with a distal end opposite said dome end and a tube which extends from said end portion into said lamp vessel towards said dome end and defines a cavity in said lamp vessel extending from said end portion, said lamp vessel having a length dimension from said distal end to said dome end, a first zone adjacent said end portion extending from said end portion toward said dome end for a distance equal to half said length dimension, and a second zone extending from said first zone to said dome end over the remaining half of said length dimension;

b) a discharge sustaining filling within said lamp vessel; and c) a power coupler within said tube in said lamp vessel, said power coupler comprising a core of soft magnetic material, an electric coil around the core, said coil being disposed adjacent to said end portion of said lamp vessel substantially entirely within said first zone, a solid heat conducting rod within said core of soft magnetic material which extends to the exterior of said tube past said end portion, and an elastic material laterally coupling said heat conducting rod to said core of soft magnetic material;

d) a flange adjacent said end portion and coupled to said heat conducting rod; and wherein during lamp operation said lamp consumes a power of at least about 40 W.

2. An electrodeless low-pressure discharge lamp as claimed in claim 1, characterized in that the flange has a surface which becomes narrower towards the rod.

3. An electrodeless low-pressure discharge lamp as claimed in claim 2, characterized in that the flange is integral with the rod.

4. An electrodeless low-pressure discharge lamp as claimed in claim 1, characterized in that the elastic material is silicone rubber.

5. An electrodeless discharge lamp according to claim 1, wherein said magnetic core extends substantially entirely within said first zone.

6. An electrodeless discharge lamp according to claim 1, wherein said core and coil each extend entirely within said first zone.

7. An electrodeless discharge lamp according to claim 5, wherein said coil extends entirely within said first zone.

8. An electrodeless low pressure discharge lamp, comprising:

a) a lamp vessel closed in a gas-tight manner and comprising a dome end, a neck shaped end portion having a distal end opposite said dome end and a tube which extends into said lamp vessel from said distal end and defines a cavity in said lamp vessel extending from said distal end towards said dome end, said tube including a flared portion fused to said neck shaped end portion of said lamp vessel and a cylindrical portion extending from said flared portion towards said dome end, said lamp vessel having a length dimension from said distal end of said end portion to said dome end, a first zone adjacent said end portion extending from said end portion toward said dome end for a distance equal to half said length dimension, and a second zone extending from said first zone to said dome end over the remaining half of said length dimension;

b) an ionizable filling, comprising rare gas, within said lamp vessel;

c) a power coupler within said tube in said lamp vessel, said power coupler comprising a core of soft magnetic material, an electric coil around the core, said core and coil being disposed adjacent said flared portion substantially entirely within said first zone, a solid heat conducting rod within said core which extends to the exterior of said tube past said end portion, and an elastic material laterally coupling said heat conducting rod to said core of soft magnetic material; and d) a heat dissipating flange adjacent said end portion and coupled to said heat conducting rod for dissipating heat from said core of magnetic material, said flange having a flared shape complementary to said flared end portion of said discharge vessel; and wherein during lamp operation said lamp consumes a power of at least about 40 W.

9. An electrodeless lower-pressure discharge lamp as claimed in claim 8, characterized in that said flange is integral with said rod.

10. An electrodeless low-pressure discharge lamp as claimed in claim 8, characterized in that said elastic material is silicone rubber.

11. An electrodeless low-pressure discharge lamp according to claim 8, including means for detachably securing said power coupler to said discharge vessel.

12. An electrodeless discharge lamp according to claim 8, wherein said core and coil each extend entirely within said first zone.

13. An electrodeless discharge lamp according to claim 8, wherein said coil extends entirely within said first zone.

14. An electrodeless low pressure discharge lamp, comprising:

a) a lamp vessel closed in a gas-tight manner and comprising a dome end, a basal end opposite said dome end, and a re-entrant tube which extends from said basal end into said lamp vessel towards said dome end and defines a cavity within said lamp vessel, said lamp vessel having a length dimension between said basal end and said dome end;

b) a discharge-sustaining filling within said lamp vessel; and c) a power coupler within said tube in said lamp vessel, said power coupler comprising a core of soft magnetic material, an electric coil around the core, said core and coil being disposed adjacent said basal end and extending from said basal end towards said dome end no more than half of said length dimension of said lamp vessel, a solid heat conducting rod within said core which extends to the exterior of said tube past said basal end, and an elastic material laterally coupling said heat conducting rod to said core of soft magnetic material; and d) a heat-dissipating flange adjacent said basal end and coupled to said heat conducting rod for dissipating heat from said core of magnetic material, said flange having a flared shape narrowing towards said heat conducting rod, and wherein during lamp operation said lamp consumes a power of at least about 40 W.

* * * * *